US005584797A

United States Patent [19]

Yoo

[11] Patent Number: 5,584,797

[45] Date of Patent: Dec. 17, 1996

[54] KNEADER AND THE METHOD OF ITS PRODUCTION

[76] Inventor: Young-Yoon Yoo, Seoul, Rep. of Korea

[21] Appl. No.: 274,739

[22] Filed: Jul. 18, 1994

[30] Foreign Application Priority Data

Dec. 18, 1993 [KR] Rep. of Korea ..... 28507/1993

[51] Int. Cl.[6] ..... A61H 1/00

[52] U.S. Cl. ..... 601/56; 601/46

[58] Field of Search ..... 601/46, 56–62, 601/67, 69, 70–74

[56] References Cited

U.S. PATENT DOCUMENTS

| | | | |
|---|---|---|---|
| 3,457,911 | 7/1969 | Carpenter | 601/57 |
| 3,636,945 | 1/1972 | Sato | 601/71 |
| 4,559,929 | 12/1985 | Hseu | 601/70 |
| 4,802,463 | 2/1989 | Rojas | 601/56 |
| 5,022,384 | 6/1991 | Freels | 601/57 |
| 5,152,708 | 10/1992 | Claugus | 601/46 |
| 5,188,096 | 2/1993 | Yoo . | |

*Primary Examiner*—Robert A. Hafer
*Assistant Examiner*—Brian E. Hanlon
*Attorney, Agent, or Firm*—Finnegan, Henderson, Farabow, Garrett & Dunner, L.L.P.

[57] ABSTRACT

The present invention relates to a massager, and the method for its production, in which the motors of vibrators to be arranged in groups of desired numbers in vertical and lateral directions and power lines are connected not using the conventional ways of soldering or the like while at the same time, power lines of the motors are, after correct arrangement, fixed firmly on the supporting member by compression by heat. Thereby, both the inner and outer shells of the body of the massager are combined into one and can be used as the supporting member, the wiring of the power lines thus being made easy and simple at once.

2 Claims, 3 Drawing Sheets

KNEADER AND THE METHOD OF ITS PRODUCTION

BACKGROUND OF THE INVENTION

The present invention relates to a mat-form massager and the method for its production, and more particularly to a massager, wherein the motors of vibrators and the power lines are connected in a simple way, and power lines are arranged with simplicity by the use of two opposed layers of an electrically insulating support member; and also to the method for production of such a massager.

The mat-type massager or jacket-type massager of the prior art consists, generally, of vibrators driven by control power lines, an inner shell wired with power lines, and an outer shell enveloping the vibrators and the power lines alike. In production of the massager of the prior art, a vibrator is placed at a certain desirable position of the inner shell, the power lines are joined to the motor of the vibrator by means of soldering or otherwise, then the power lines joined to the motor of the vibrator are distributed inside the body of the massager in accordance with the control of the vibrator, and subsequently the vibrator and wiring are enveloped by the outer shell to form the body of a massager.

But the method for production in the prior art requires not merely connection of power lines with the motors of vibrators by means of soldering, for instance, but wiring each motor separately to store the power lines inside the inner shell of the massager according to various ways to control, wherefore the task is complicated and entails need for more workers and the rise in labor costs.

Kneaders like massage mats and massaging jackets result in a cost rise also by using separate inner and outer shells.

SUMMARY OF THE INVENTION

In view of all these factors, the present invention is intended to provide a simple way of joining the motors of vibrators and power lines, avoiding the trouble of soldering and the like; making both the inner and outer shells of the body of a massager in one, enabling them to serve as the supporting member; and concurrently placing the wiring of power lines inside this supporting member.

The massager of the present invention, to attain the object set forth above, is distinctive in its being an easy device to make at low cost in that, in a massager including a plurality of vibrators with a supporting member, each of the vibrators comprising a cylindrical motor setting a positive or negative electrode on a cylindrical part thereof, an eccentric weight fixed on the revolving axles of the motors, a pair of power lines to be in contact with the electrodes to supply power source to the motor, a pair of buffers for strengthening the connection of electrodes of said motor and power lines, and upper and lower casing parts.

The supporting member is made of two sheets of electrically insulating and flexible material, and the vibrators are arranged in vertical and lateral directions and fixed inside the supporting member, and the power lines are fixed directly on the supporting member.

The method for producing a massager of the present invention, with wire power lines inside a supporting member supporting a plurality of vibrators, includes the following steps:

wiring flexible naked copper lines inside a double-layer supporting member of electrically insulating and flexible material in corresponding relationship to each position of said vibrators and arranged in groups in vertical and lateral directions and attaching said supporting member so as to fix said power lines firmly;

cutting a hole out at each position of said supporting member where each vibrator is placed so that the motor of each vibrator can pass through;

fixing each case of each vibrator at a respective position where a hole is cut out and pushing one buffer into a concave groove of each case through the respective hole, while at the time inserting a respective motor in the concave groove of each case, with one of the power lines kept in contact with an electrode on one side of the motor, thus fixing the motor and the one power line for a time, and;

setting another power line and buffer on the opposite electrode of the motor and fastening to the case on the motor another case on the opposite side by means of a screw to fix firmly each power line on the opposite side to the opposite electrode of the motor and at the same time fixing said vibrator firmly to the supporting member.

The method for producing a massager of the present invention has advantages over those of the prior art in reducing the time cost; and material cost in production also because power lines are wired directly inside the double-layer supporting member in accordance with the required methods of control and are fixed firmly to the supporting member by high frequency heating or otherwise by application of heat by hot plates, the motors are inserted in the concave groove with each of the power lines connected to each of the electrodes of the motors without taking the trouble of soldering or the like, and finally cases are simply fastened by screws—whereby the body of the massager is constructed in a simple way.

DESCRIPTION OF THE PREFERRED EMBODIMENT

Figure 1:
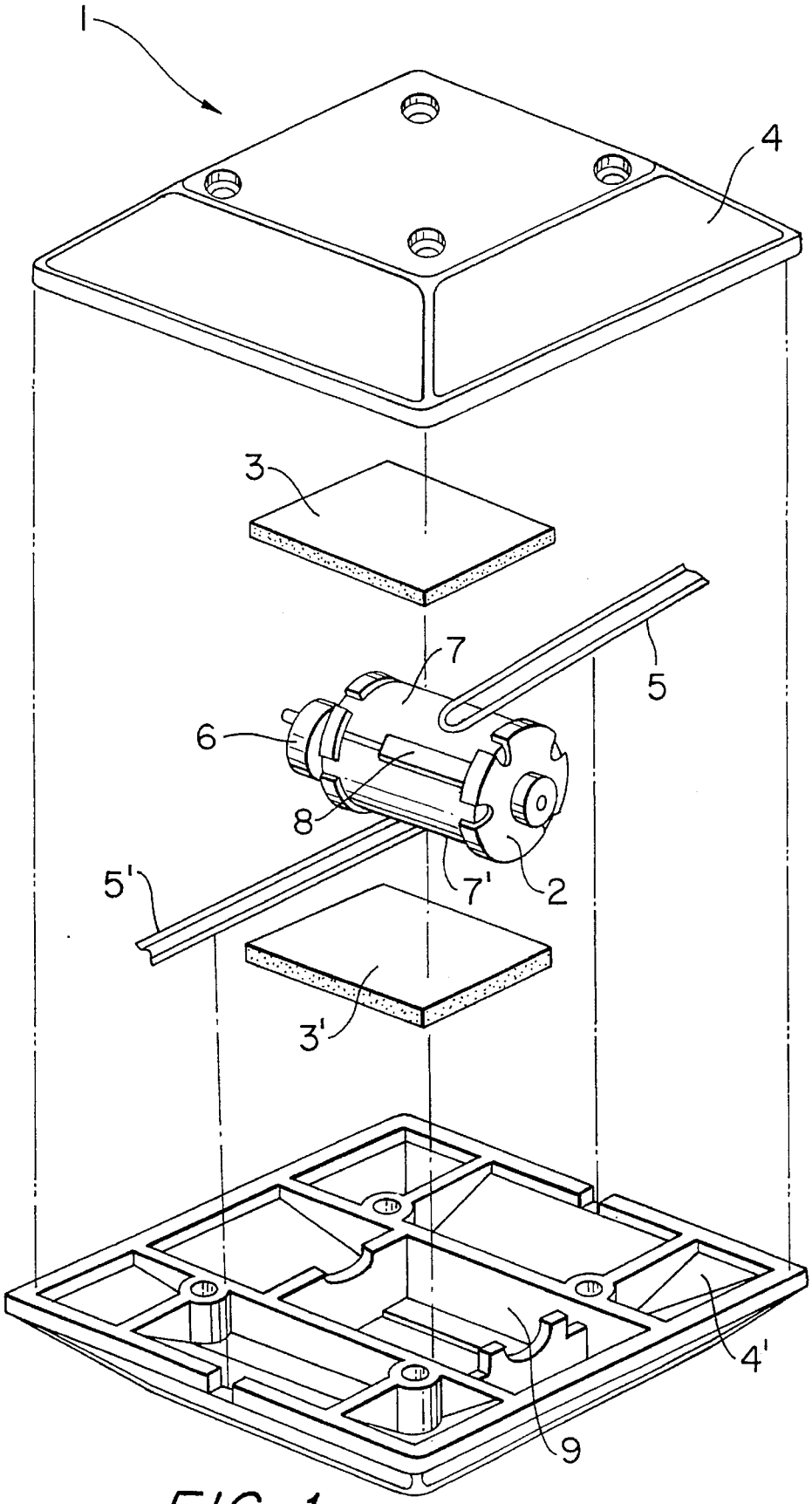
FIG. 1 shows the motor of a vibrator and the connection of the power lines in the present invention.

A vibrator 1 is made of a motor 2, buffers 3, 3' and a pair of cases 4, 4' of the motor 2, and is connected with power lines. 5, 5'. The motor 2 conveys its vibration to the vibrator 1 by an eccentric weight 6 hanging from a revolving axle of the motor 2; and a cylinder, divided in two by a ceramic member 8 of nonconductive material, is so made as to form negative (–) and positive (+) electrodes 7, 7' for connection of power lines 5, 5'. The buffers 3, 3' is inserted between the motor 2 and vibrator cases 4, 4' to strengthen the connection of the motor electrodes 7, 7' and the power lines 5, 5'; that is, the power lines 5, 5' can be prevented from getting severed from the electrodes 7, 7' by firm fastening of the upper and lower cases 4, 4' of the vibrator, with the two sheets of buffers 3, 3' inserted inbetween.

Even if an impact is delivered to the buffers 3, 3', the impact on the connection of the electrodes 7, 7' and power lines 5, 5' can be reduced a great deal.

Figure 2:
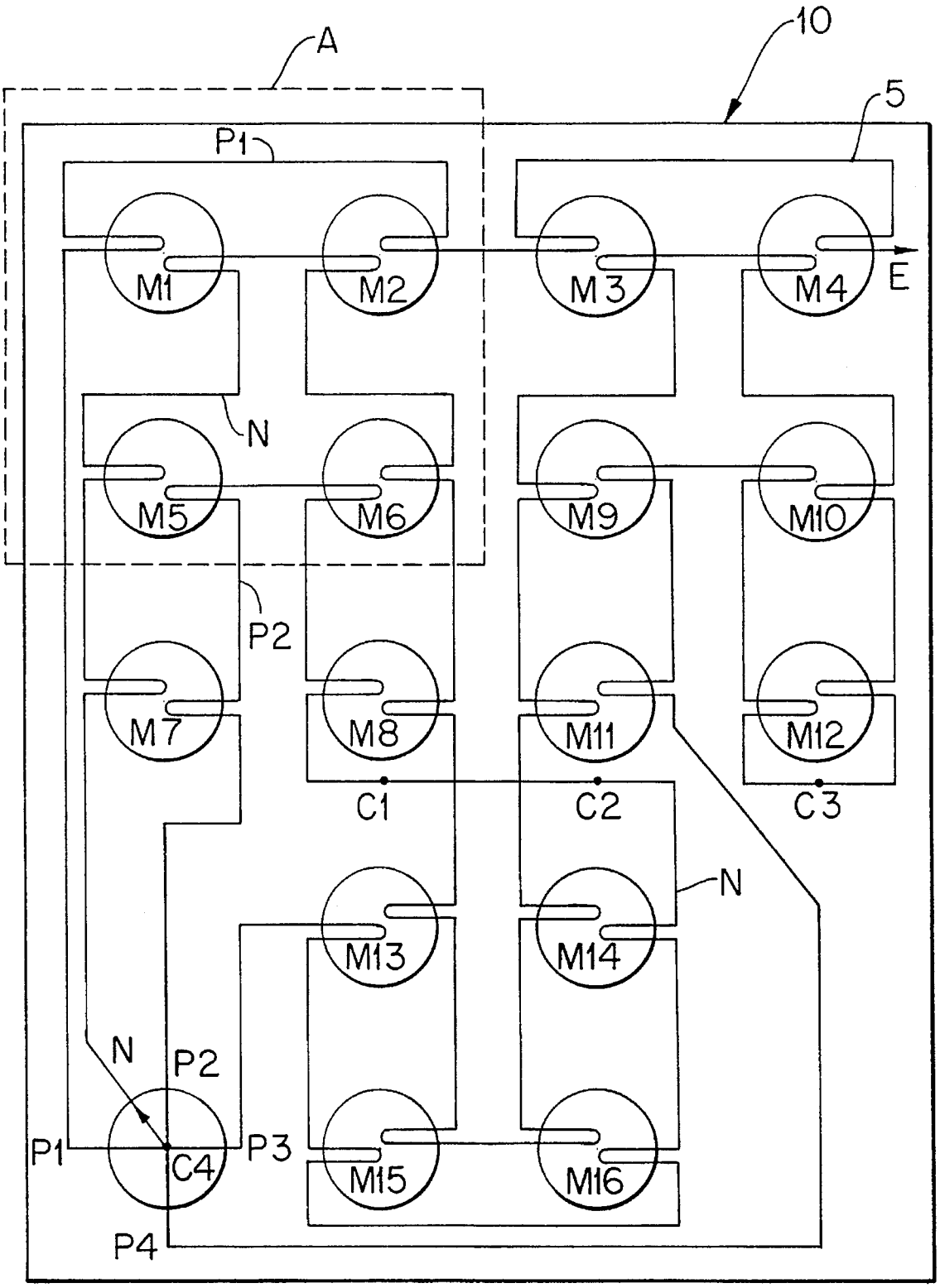
FIG. 2 shows the supporting member with its wired power lines in an embodiment of the present invention.
Figure 3:
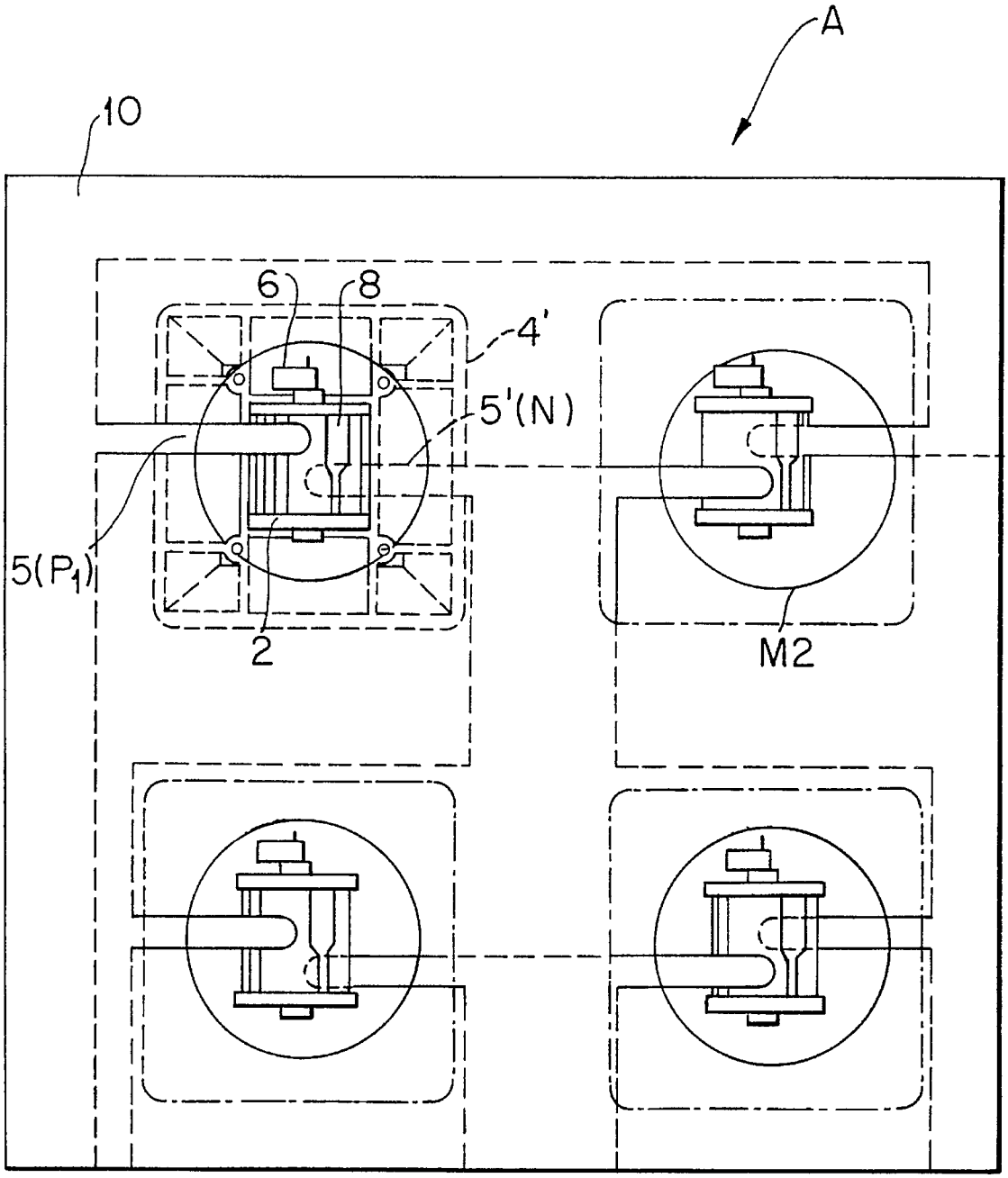
FIG. 3 shows the Part A of FIG. 2 in detail.

The body, the main component of the massager, consists of vibrators arranged in accordance with the desired ways of control in the present invention with respective pluralities in vertical and lateral directions and divided into a certain number of groups by power lines for performance of the massage; and in the present example of the embodiment, as shown in the FIG. 2, 16 vibrators M1–M16 are arranged in four groups of four so as to massage one's shoulders and backs properly, enwrapped in a supporting member of two layers of flexible and electrically insulating PVC, PB or synthetic leather of 0.3 mm in thickness, wired with power lines for controlling material being fused by high-frequency heating or heat by hot; plates so that both the inner and outer shells are made one. Thereby, production of the massager is made easy and low-cost.

The power lines 5, 5' are divided in accordance with the desired ways of control, e.g., by dividing them into four groups of vibrators M1–M16, that is, Control Groups 1, 2, 3 and 4—with one electrode of the motor 2 of each of all the vibrators M1–M16 wired to share one common power line N and with the other electrode of each wired into a mechanical or electronic control device outside so that each control group will share one common power line 5, 5'—are possibly more easily distributed inside the supporting member 10 resulting in less cost for installation and fewer missed connections or bad connections than in the case of using separate lines.

The method for production of a massager of the present invention is as follows:

After first wiring power lines 5 of naked copper, to suit the loci of vibrators M1–M13 arranged in a desired number in lateral and vertical directions, inside a supporting member 10 doped with 0.3 mm thick synthetic resin (e.g. PVC, PE, or synthetic leather of soft nature) or with adhesive setting by heat, which possesses flexibility and electrically insulating capability, next fixing firmly the power line 5 on the supporting member 10 in that state of distribution by heating the supporting member 10 by high-frequency heating or otherwise by applying heat by hot plates. Thus, the supporting member 10 is turned into a single shell.

Then, at each point at which the vibrators M1–M16 are to be set into the supporting member 10, a hole of a size to allow the passage of each built-in motor 2 of each of the vibrators M1–M16 is cut out.

Now on one side of the supporting member 10 with the cut out hole is placed a side of a case 4' of each of the vibrators M1–M16, a buffer 3' is mounted on the area of the concave groove 9 in the case 4' through the hole and fixed firmly, with an end of the power line 5 kept in connection with the electrode on one side of the motor 2.

Then the motor 2 is covered with a buffer 3 on a wire from the power line 5 on the opposite side, the outer case 4 of each of the vibrators M1–M14 is firmly fixed on the supporting member 10, and power lines 5, 5' are connected to electrodes 7, 7' of the motor 2.

The method for arrangement of said power lines 5, 5' can be made much easier than otherwise, as shown in FIG. 2, by dividing said vibrators M1–M16, according to desired ways of control, in a certain desired number of control groups, for instance, including vibrators M1–M4 in Control Group 1, vibrators M5–M8 in Control Group 2, vibrators M9–M12 in Control Group 3, vibrators M13–M16 in Control Group 4, and wiring power lines in such a way that the electrodes 7 on a side of the motors 2 of each of all vibrators M1–M16 share common power line N, which starts at an original drawing point C4 and passes through an electrode 7' on the side of the motors 2 of another group, for instance, of vibrators M9–M12 of Control Group 3; then cutting it at the point to cut C3 with a punch or the like to set a control line P3 of a control group (Control Group 3) in a common, shared power line N; arranging the rest of the electrodes of the motors 2 of each of group of vibrators (M1–M4, M5–M8, M13–M16) of the other control groups than said control group already settled on the electrodes on both sides so that they can, by each control group, share a common power line (P1, P2, P4), whereupon Control Group 1 has a power line P1 with starts at the original drawing point C4 and terminates at a point E, Control Groups 2 and 4 start from the drawing point C4 and return to the original drawing point C4 via vibrators M7, M5, M6, M8, M14, M16, M15, M13; then severing the power lines at the points to cut C1, C2 with a punch or the like to form two power lines P2 and P4.

The method for production of a massager of the present invention, of the construction given above, has advantages over those of the prior art in reducing the time cost in its production and in saving material cost also because power lines 5, 5' are wired directly inside the opposed layers of supporting member 10 in accordance with the required methods of control and are fixed firmly to the supporting member 10 by high-frequency heating or otherwise by application of heat by hot plates. The motors 2 are inserted in the concave groove 9, with each of the power lines 5, 5' fastened to each of the electrodes 7, 7' of the motors 2 without taking the trouble of soldering or the like, and finally cases 4, 4' are simply fastened by screws. Thus, the body of the massager is constructed in a simple way.

What is claimed is:

1. A method of manufacturing a massager, comprising the steps of:

arranging between first and second flexible, insulative opposed sheets of a supporting member a plurality of flexible bare-wire power lines serpentinely sequentially traversing an array of positions in a plurality of columns and a plurality of rows;

cutting an opening to each position of said array of positions for insertion of respective vibrators;

inserting, through said openings to said array of positions, said respective vibrators for connection of said bare-wire power lines at respective external connections areas of said vibrators; and connecting and covering said vibrators, including insulatively overlaying and fixing said bare-wire power lines at said external connection areas and at the same time fixing and covering said vibrators with said opposed sheets of said supporting member.

2. The method of manufacturing a massager according to claim 1, wherein said connecting and covering step includes fusing the opposed sheets of said supporting member to said vibrators, to said bare-wire power lines, and to each other.

* * * * *